US006321701B1

(12) United States Patent
Vorih et al.

(10) Patent No.: US 6,321,701 B1
(45) Date of Patent: Nov. 27, 2001

(54) LOST MOTION VALVE ACTUATION SYSTEM

(75) Inventors: Joseph M. Vorih, West Suffield; James F. Egan, III, Suffield, both of CT (US)

(73) Assignee: Diesel Engine Retarders, Inc., DE (US)

( * ) Notice: Subject to any disclaimer, the term of this patent is extended or adjusted under 35 U.S.C. 154(b) by 0 days.

(21) Appl. No.: 09/185,600

(22) Filed: Nov. 4, 1998

Related U.S. Application Data

(60) Provisional application No. 60/064,206, filed on Nov. 4, 1997, provisional application No. 60/065,815, filed on Nov. 14, 1997, and provisional application No. 60/066,096, filed on Nov. 17, 1997.

(51) Int. Cl.[7] ..... F01L 13/00; F02D 13/04

(52) U.S. Cl. ..... 123/90.12; 123/90.16; 123/321

(58) Field of Search ..... 123/90.11, 90.12, 123/90.13, 90.15, 90.16, 90.22, 320, 321, 322, 323, 568.14

(56) References Cited

U.S. PATENT DOCUMENTS

| | | | | |
|---|---|---|---|---|
| 3,220,392 | | 11/1965 | Cummins . | |
| 4,278,233 | | 7/1981 | Zürner et al. . | |
| 4,572,114 | | 2/1986 | Sickler . | |
| 4,592,319 | | 6/1986 | Meistrick . | |
| 4,716,863 | | 1/1988 | Pruzan . | |
| 4,742,806 | | 5/1988 | Tart, Jr. et al. | 123/322 |
| 4,765,288 | * | 8/1988 | Linder et al. | 123/90.16 |
| 4,930,465 | | 6/1990 | Wakeman et al. . | |
| 4,936,273 | | 6/1990 | Myers | 123/322 |
| 5,127,375 | * | 7/1992 | Bowman et al. | 123/90.12 |
| 5,146,890 | | 9/1992 | Gobert et al. . | |
| 5,190,013 | * | 3/1993 | Dozier | 123/481 |
| 5,193,494 | * | 3/1993 | Sono et al. | 123/90.12 |
| 5,253,619 | | 10/1993 | Richeson et al. . | |
| 5,537,976 | | 7/1996 | Hu . | |
| 5,609,133 | * | 3/1997 | Hakansson | 123/321 |
| 5,619,965 | * | 4/1997 | Cosma et al. | 123/322 |
| 5,680,841 | | 10/1997 | Hu . | |
| 5,787,859 | | 8/1998 | Meistrick et al. . | |
| 5,829,397 | | 11/1998 | Vorih . | |
| 5,839,400 | * | 11/1998 | Vattaneo et al. | 123/90.16 |
| 5,839,453 | | 11/1998 | Hu | 123/322 |
| 5,970,956 | * | 10/1999 | Sturman | 123/508 |

* cited by examiner

*Primary Examiner*—Weilun Lo
(74) *Attorney, Agent, or Firm*—Collier Shannon Scott, PLLC

(57) ABSTRACT

A lost motion valve actuation system for an internal combustion engine is disclosed. The system includes a motion feedback system (100) for detecting the motion and timing of a valve actuator (130) and an engine valve (140). By providing information on the condition of the engine during operation, the motion feedback system (100) permits adjustment of the valve actuation system that can optimize operation or prevent engine damage. The motion feedback system may be used in a common rail or a lost motion valve actuation system. In alternate embodiments, the valve actuation system includes an accumulator (300) with an accumulator piston (310) whose motion is limited by an accumulator stop (330) or a control valve (200). The limited accumulator (300) controls the amount of lost motion in the valve actuation system to provide fail-safe operation in the event of electrical failure. The valve actuation system is operable for engine positive power, compression release braking, and exhaust gas recirculation modes of operation.

13 Claims, 4 Drawing Sheets

LOST MOTION VALVE ACTUATION SYSTEM

CROSS REFERENCE TO RELATED PATENT APPLICATIONS

This application relates to and claims priority on Provisional Application Ser. No. 60/064,206, entitled "Fail-Safe, Fully Hydraulic Lost Motion Valve Actuation System," filed Nov. 4, 1997; Provisional Application Ser. No. 60/065,815, entitled "Motion Feedback System for Valve Actuators," filed Nov. 14, 1997; and Provisional Application Ser. No. 60/066,096, entitled "Exhaust Valve Operating System for Internal Combustion Engine Braking," filed Nov. 17, 1997.

FIELD OF THE INVENTION

The present invention relates to engine valve actuation systems for internal combustion engines. In particular, the present invention relates to systems, used during positive power engine, braking, and exhaust gas recirculation, for providing a fail-safe, hydraulic control of the amount of "lost motion" between an engine valve and a means for opening the valve. In addition, the present invention relates to a system for detecting motion of a valve actuator of a common rail or lost motion valve actuation system.

BACKGROUND OF THE INVENTION

In many internal combustion engines the engine cylinder intake and exhaust valves may be opened and closed by fixed profile cams in the engine, and more specifically by one or more fixed lobes which may be an integral part of each of the cams. The use of fixed profile cams makes it difficult to adjust the timings and/or amounts of engine valve lift to optimize valve opening times and lift for various engine operating conditions, such as different engine speeds.

One method of adjusting valve timing and lift, given a fixed cam profile, has been to incorporate a "lost motion" device in the valve train linkage between the valve and the cam. Lost motion is the term applied to a class of technical solutions for modifying the valve motion proscribed by a cam profile with a variable length mechanical, hydraulic, or other linkage means. In a lost motion system, a cam lobe may provide the "maximum" (longest dwell and greatest lift) motion needed over a full range of engine operating conditions. A variable length system may then be included in the valve train linkage, intermediate of the valve to be opened and the cam providing the maximum motion, to subtract or lose part or all of the motion imparted by the cam to the valve.

This variable length system (or lost motion system) may, when expanded fully, transmits all of the cam motion to the valve, and when contracted fully, transmit none or a minimum amount of the cam motion to the valve. An example of such a system is provided in U.S. Pat. No. 5,537,976 to Hu and U.S. Pat. No. 5,680,841, also to Hu, which are assigned to the same assignee as the present application, and which are incorporated herein by reference.

In the lost motion system of U.S. Pat. No. 5,680,841, an engine cam may actuate a master piston which displaces fluid from its hydraulic chamber into a hydraulic chamber of a slave piston. The slave piston in turn acts on the engine valve to open it. The lost motion system may be a solenoid valve and a check valve in communication with the hydraulic circuit including the chambers of the master and slave pistons. The solenoid valve may be maintained in a closed position in order to retain hydraulic fluid in the circuit. As long as the solenoid valve remains closed, the slave piston and the engine valve respond directly to the motion of the master piston, which in turn displaces hydraulic fluid in direct response to the motion of a cam. When the solenoid is opened temporarily, the circuit may partially drain, and part or all of the hydraulic pressure generated by the master piston may be absorbed by the circuit rather than be applied to displace the slave piston.

In many electronically controlled valve actuation systems, there is a need to detect the motion and timing of a valve actuator so as to know the condition of the engine during operation. In some cases, knowing the phasing or timing of the event can be used to control the system and can compensate for changes in system operating conditions or other factors. In other cases, detecting the absence of valve motion allows the control system to shut off fuel injection or other valve motions for an affected cylinder so as to prevent engine damage. In the present invention, Applicants further disclose a system for detecting the motion of a valve actuator that may be used in a common rail or lost motion valve actuation system. A low-cost, on/off position sensor is used to detect whether or not a slave piston has moved, thus providing confirmation that the circuit is operational. By checking the time at which the slave piston moves to a certain distance (that at which the sensor changes state), the control module can compensate for system leads/lags versus desired timing.

In designing lost motion valve actuation systems, many different approaches have been considered. Hydromechanical systems allow for partial lost motion, while preserving mechanical valve actuation to some lesser extent than standard. These designs are somewhat complex, and experience difficult loading conditions during compression release retarding. Valve train designs employing a purely hydraulic system are flexible and conceptually simple to design, requiring only hydraulic connections between master pistons and slave pistons. For example, U.S. Pat. No. 4,278,233 to Zürner et al. discloses a hydraulic system for actuating gas-change valves in an internal combustion engine. Such systems are unlikely to achieve rapid acceptance in the conservative engine market due to their pronounced departure from conventional technology. These systems will not operate at all if oil pressure, fluid passage continuity or electrical element control is lost.

Previous lost motion systems have typically not utilized high speed mechanisms to rapidly vary the length of the lost motion system. Lost motion systems of the prior art have accordingly not been variable such that they may assume more than one length during a single cam lobe motion, or even during one cycle of the engine. By using a high speed mechanism to vary the length of the lost motion system, more precise control may be attained over valve actuation, and accordingly optimal valve actuation may be attained for a wide range of engine operating conditions.

Applicants have determined that the lost motion system of the present invention may be particularly useful in engines requiring valve actuation for both positive power and for compression release retarding and exhaust gas recirculation valve events. Typically, compression release and exhaust gas recirculation events involve much less valve lift than do positive power related valve events. Compression release and exhaust gas recirculation events may, however, require very high pressures and temperatures to occur in the engine. Accordingly, if left uncontrolled (which may occur with the failure of a lost motion system), compression release and exhaust gas recirculation could result in pressure or temperature damage to an engine at higher operating speeds. Therefore, Applicants have determined that it may be beneficial to have a lost motion system which is capable of providing control over positive power, compression release, and exhaust gas recirculation events, and which will provide only positive power or some low level of compression release and exhaust gas recirculation valve events, should the lost motion system fail.

An example of a lost motion system used to obtain retarding and exhaust gas recirculation is provided by U.S. Pat. No. 5,146,890 to Gobert, assigned to AB Volvo, and incorporated herein by reference. Gobert discloses a method of conducting exhaust gas recirculation by placing the cylinder in communication with the exhaust system during the first part of the compression stroke and optionally also during the latter part of the inlet stroke. Gobert uses a lost motion system to enable and disable retarding and exhaust gas recirculation, but such a system is not variable within an engine cycle.

The challenge addressed by the present invention is to employ lost motion valve actuation to achieve the benefits of variable valve actuation and the flexibility of hydraulic valve train design while preserving a predictable operating mode in the event of startup or failure conditions. In the present invention, Applicants disclose embodiments directed to both a fully hydraulic valve actuation system and a hydromechanical valve actuation system with electrical control.

Applicants' method for implementing the flexible advantages of a fully hydraulic lost motion valve actuation system, while incorporating some measure of fail-safe operation, is accomplished by limiting the amount of motion which can be lost by designing the accumulator to accept less than a complete master piston stroke of working fluid.

In another embodiment of the present invention, Applicants disclose a system for valve actuation that employs a hydromechanical system with fail-safe features. It is known that internal combustion engines can be used to effect kinetic energy braking of a rolling vehicle by interrupting the engine's fuel flow, and operating the engine as an air compressor. In this mode, the rolling vehicle's kinetic energy is converted to potential energy (compressed air), and subsequently the potential energy is depleted by exhausting the compressed air into the atmosphere through the vehicle's exhaust system. Engine braking is described in detail in U.S. Pat. No. 3,220,392 to Cummins, which is incorporated herein by reference.

The effectiveness of engine compression braking can be improved further by recirculating exhaust gas into each cylinder at the time a cylinder's piston is at or near dead bottom at the beginning of the normal compression stroke. This process is commonly referred to as Exhaust Gas Recirculation or "EGR". Including EGR in a compression braking cycle will result in the introduction of a greater volume of air to a given engine cylinder. Consequently, the engine works harder compressing the denser air volume and, as a result, more kinetic energy is converted into potential energy resulting in greater engine retardation.

EGR may also be used during normal positive power operation. The benefits derived from EGR during positive power operations are: (1) increased fuel-use efficiency due to the consumption of unburned combustibles in the exhaust gas; and (2) cleaner exhaust gas emissions. Details of EGR operating modes are provided in U.S. Pat. No. 5,787,859, which is assigned to the same assignee as the present application, and which is incorporated herein by reference.

Cylinder exhaust valves open at different times during engine braking and EGR operations than during positive power operations. For engine braking, the exhaust valves open at or near top dead center at the completion of a cylinder's compression stroke. For EGR events, the exhaust valve opens at or near the aforementioned dead bottom at or near the beginning of the compression stroke. The engine's conventional valve opening system associated with positive power operations holds a cylinder's exhaust valve closed at these times. Consequently, add-on systems that augment or modify the conventional exhaust valve opening system may be applied to internal combustion engines in order to permit engine braking and EGR operating modes.

Present engine braking and EGR systems derive the time for opening each cylinder's exhaust valve from a neighboring cylinder's intake or exhaust valve opening systems. The mechanical motion of the neighboring cylinder's main event valve opening system is transmitted to the selected cylinder's exhaust valve by add-on mechanical or hydromechanical systems. Engine braking and EGR exhaust valve opening derived in this fashion have certain disadvantages. For example, it may not be possible to open the exhaust valve at the optimum time for EGR and brake events. Also, the add-on systems add additional weight and size to an engine. As a result, there is a need for a system which provides optimum exhaust valve timing, opening duration, and lift for EGR and braking events. A system which provides independent control of each cylinder's valve(s) would be capable of provide optimum opening profiles (timing, duration, and lift) and result in increased braking energy, and improved engine efficiency.

Applicants' alternative system for valve actuation replaces a conventional internal combustion engine's mechanical exhaust valve opening system with a hydromechanical system wherein auxiliary cam-actuated valve openings for engine braking can be inhibited or permitted by driver-initiated electrical control. Applicants' present invention preserves normal positive power operation, and incorporates certain fail-safe features in the event of electrical control failure.

OBJECTS OF THE INVENTION

It is therefore an object of the present invention to provide an internal combustion engine with an innovative and economical valve actuation system.

It is a further object of the present invention to provide valve motion detection.

It is a further object of the present invention to provide a system that provides feedback of actuator timing.

It is yet a further object of the present invention to provide a system that provides feedback of actuator motion.

It is still a further object of the present invention to provide a system that is capable of detecting failed valve events.

It is another object of the present invention to provide fully hydraulic valve actuation within practical limits.

It is a further object of the present invention to provide a fully hydraulic valve actuation system with a fail-safe operating condition.

It is yet another object of the invention to provide a fully hydraulic valve actuation system with a flexible system design.

It is still another object of the invention to provide a fully hydraulic valve actuation system with a limited lost motion capability.

It is also an object of the present invention to provide a fully hydraulic valve actuation system with limited accumulator motion.

It is another object of the present invention to provide controllable EGR and kinetic braking modes of an internal combustion engine.

It is yet another object of the present invention to provide optimum operation of an internal combustion engine's kinetic braking system.

It is a still another object of the present invention to provide an internal combustion engine with independently controlled valves.

It is also an object of the present invention to provide optimum control of engine valve timing.

It is a further object of the present invention to provide optimum control of engine valve lift.

It is a further object of the present invention to provide optimum control of the duration that the exhaust valve is open.

It is still a further object of the present invention to provide a fail-safe mode wherein positive power engine operation is not seriously impaired by electrical failure.

Additional objects and advantages of the invention are set forth, in part, in the description which follows and, in part, will be apparent to one of ordinary skill in the art from the description and/or from the practice of the invention.

SUMMARY OF THE INVENTION

In response to the foregoing challenges, Applicants have developed an innovative, economical system for controlling engine valve operation in an internal combustion engine. The present invention is directed to a motion feedback system for detecting the motion and timing of an engine valve. The present invention is also directed to a system with a limited accumulator which controls the amount of lost motion in the valve actuation system to provide fail-safe operation in the event of electrical failure.

The present invention is directed to a valve actuation system for an internal combustion engine with at least one engine cylinder valve which is selectively openable. The valve actuation system may comprise actuating means for actuating at least one engine valve, detection means for detecting braking and exhaust motion of at least one engine valve in response to actuation of at least one engine valve by the actuating means and control means for controlling the actuating means in response to the detection means.

The valve actuation system of the present invention may further comprise means for imparting force from a force source to selectively operate at least one engine valve, a fluid system connected to the force imparting means for variably controlling the position of at least one engine valve, an accumulator connected to the fluid system, a control valve connected to the fluid system, means for actuating at least one engine valve in response to force imparted by the force imparting means through the fluid system, and a motion feedback system for detecting braking and exhaust motion of at least one engine valve in response to actuation of at least one engine valve by the actuating means.

The actuating means may comprise a slave piston slidably disposed within a slave piston bore in the brake housing, wherein the slave piston is connected to the fluid system and a valve actuator connected to the slave piston, wherein the valve actuator is in communication with at least one engine valve, upon displacement of the slave piston.

The motion feedback system may comprise at least one position sensor capable of detecting the motion of the valve actuator, and a control module electrically connected to at least one position sensor. The control module may be electrically connected to the control valve, to control the operation of the control valve in response to motion detected by at least one position sensor. The position sensor produces a position output signal in response to detecting the motion of the valve actuator past a switching point. The switching point of the valve actuation system of the present invention is adjustable.

The present invention is further directed to a valve actuation system which may comprise means for imparting force from a force source to selectively operate at least one engine valve, a fluid system which links at least one valve to the force imparting means such that a force derived from the force imparting means is transferred to at least one valve to operate the valve, an accumulator connected to the fluid system for selectively absorbing fluid within the fluid system to vary the operation of at least one valve, the accumulator having means for limiting the amount of an accumulated fluid within the accumulator, a control valve connected to the fluid system, and means for actuating at least one engine valve, in response to force imparted by the force imparting means through the fluid system. The accumulator may further include an accumulator piston. The accumulator limiting means limits the maximum stroke of the accumulator piston. The force imparting means may include a master piston for delivering motion from a cam, and the limiting means of the accumulator may limits the maximum stroke of the accumulator piston to a distance less than the maximum master piston lift.

In another embodiment, the present invention is directed to a valve actuation system which includes an alternate means of limiting the accumulator from absorbing the full volume of fluid displaced by the force imparting means during positive power operation of the engine. The accumulator limiting means may include a control valve connected by the fluid system to the accumulator. In this embodiment, the control valve limits displacement of the accumulator piston in the accumulator when the control valve is closed. In addition, the accumulator is capable of absorbing the full volume of fluid displaced by the master piston during predetermined operating conditions.

It is to be understood that both the foregoing general description and the following detailed description are exemplary and explanatory only, and are not restrictive of the invention as claimed. The accompanying drawings, which are incorporated herein by reference, and which constitute a part of this specification, illustrate certain embodiments of the invention and, together with the detailed description, serve to explain the principles of the present invention.

BRIEF DESCRIPTION OF THE DRAWINGS

The invention will now be described in conjunction with the following drawings in which like reference numerals designate like elements and wherein.

Detailed Description of the Preferred Embodiments

Figure 1:
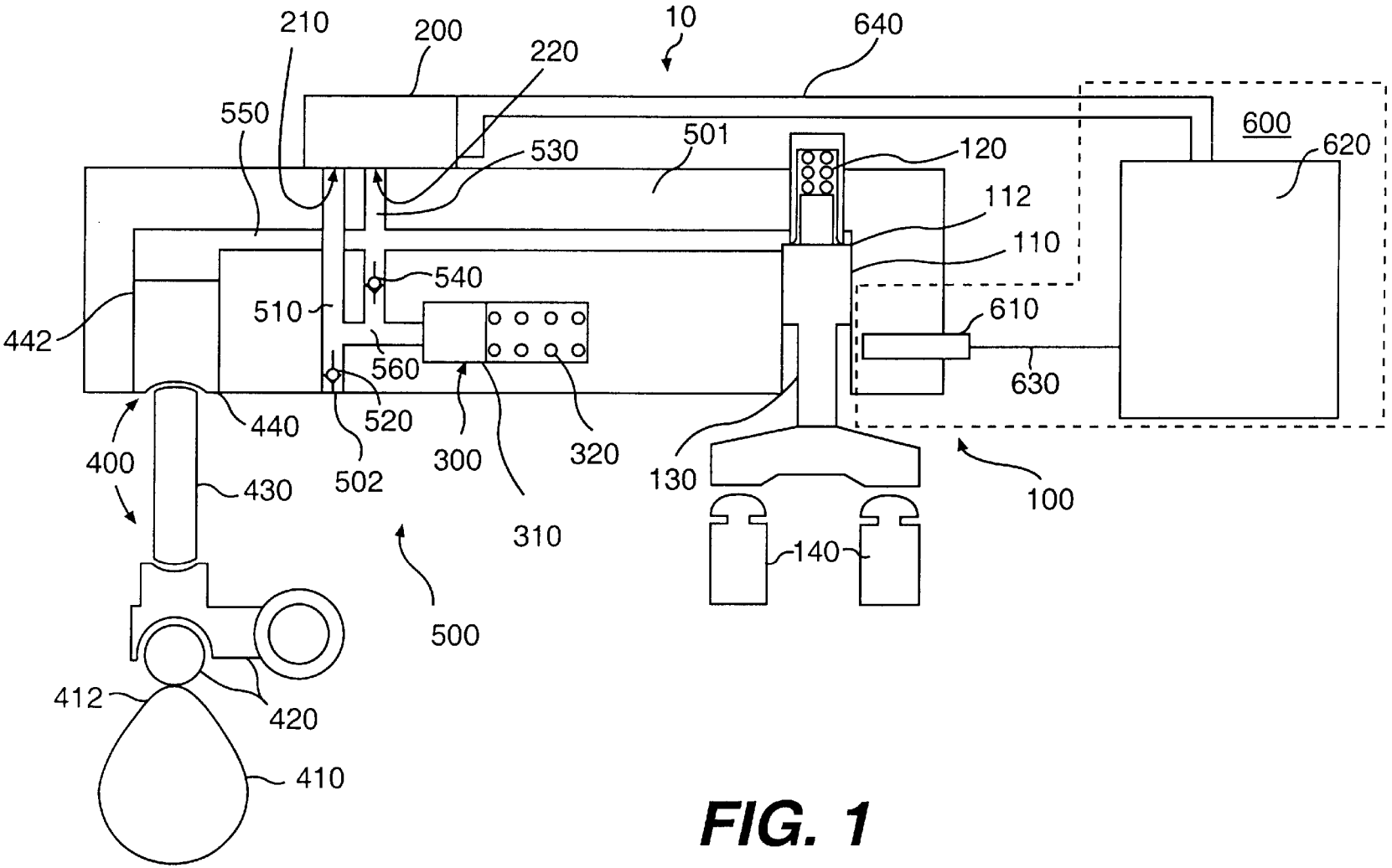
FIG. 1 is a cross-sectional schematic diagram of a valve actuation system with motion feedback system according to a preferred embodiment of the present invention.

Reference will now be made in detail to an embodiment of the present invention, an example of which is illustrated in the accompanying drawings. An embodiment of a valve actuation system with motion feedback system for an internal combustion engine is shown in FIG. 1 as 10. Valve actuation system 10 is provided with a force imparting system 400. Force imparting system 400 is connected to fluid system 500, provided in brake housing 501. Fluid system 500 is connected to control valve 200, accumulator 300, and slave piston 110. Slave piston 110 is connected to valve actuator 130, which is in communication at least one exhaust valve 140. In a preferred embodiment, valve actuation system 10 is also provided with motion feedback system 100. Motion feedback system 100 comprises valve actuation control assembly 600, slave piston 110, and valve actuator 130. Valve actuation control assembly 600 is electrically connected to control valve 200.

Force imparting system 400 includes cam 410 in communication with roller-follower 420. Roller-follower 420 is connected to push-tube 430. Push-tube 430 is connected to master piston 440.

As embodied herein, fluid system 500 comprises conduits in brake housing 501, including first fluid passage 510, second fluid passage 530, third fluid passage 550, and fourth fluid passage 560. First fluid passage 510 includes first check valve 520. Second fluid passage includes second check valve 540. Accumulator 300 is connected to fluid system 500 by fourth fluid passage 560. Control valve 200 is connected to fluid system 500 by first fluid passage 510 and second fluid passage 530. Control valve 200 further includes first port 210 connected to first fluid passage 510 and second port 220 connected to second fluid passage 530.

With continuing reference to FIG. 1, system 10 includes slave piston 110, slave piston spring 120 and valve actuator 130. Slave piston 110 is slidably disposed in bore 112, and is urged toward engine valve 140 by spring 120. Valve actuator 130 is connected to slave piston 110 and may come into communication with engine valve 140 when slave piston 110 is displaced.

Valve actuation control assembly 600 includes position sensor 610 and control module 620. Position sensor 610 may be a Hall-effect position sensor. Position sensor 610 is electrically connected to control module 620 through first electrical connection 630. Control module 620 is electrically connected to control valve 200 through second electrical connection 640.

Accumulator 300 is provided with accumulator piston 310 and accumulator spring 320. Accumulator piston 310 is slidably disposed in accumulator 300, and is urged toward fluid source end of accumulator 300 by accumulator spring 320.

With continuing reference to FIG. 1, valve actuation system 10, as embodied herein, operates as follows: motion of cam 410 is transferred to engine valve 140 through fluid system 500. Fluid system 500 is preferably filled with low pressure (nominally 30–60 psi) engine lubricating oil from the engine crank case (not shown), however, other fluids are contemplated to be within the scope of the present invention. When control valve 200 is open, working fluid is taken into accumulator 300 until accumulator piston 310 is driven against some limit, shown in this preferred embodiment as accumulator spring 320. After accumulator 300 is driven against its spring 320, additional motion of master piston 440 will result in slave piston 110 displacement, regardless of the condition of control valve 200. Displacement of slave piston 110 moves valve actuator 130 into communication with engine valve 140, opening engine valve 140.

When control valve 200 is open, working fluid moves freely to and from accumulator 300. As cam 410 rotates, master piston 440 moves, thereby displacing a volume of the working fluid.

As embodied herein, motion feedback system 100 operates as follows: position sensor 610 is used to change or switch the state of a high/low output signal to control module 620 when valve actuator 130 moves past a certain point. By choosing the "switching" point of sensor 610, it is possible to determine whether or not specific valve events created by a flexible valve actuation system 10 have occurred. By comparing the time at which position sensor 610 did in fact change state against an expected time, control module 620 senses whether the timing of valve actuation system 10 needs to be changed, or whether system 10 is functioning properly.

In response to signals generated by control module 620, control valve 200 may be operated to control the operation of accumulator 300 to adjust the amount of motion transferred from master piston 440 to valve actuator 130. Motion feedback system 100, as shown in FIG. 1, is used in connection with lost motion valve actuation system 10, however, it is contemplated by the present invention that motion feedback system 100 is capable of being used in numerous valve actuation systems, including but not limited to common rail electrohydraulic systems.

Figure 2:
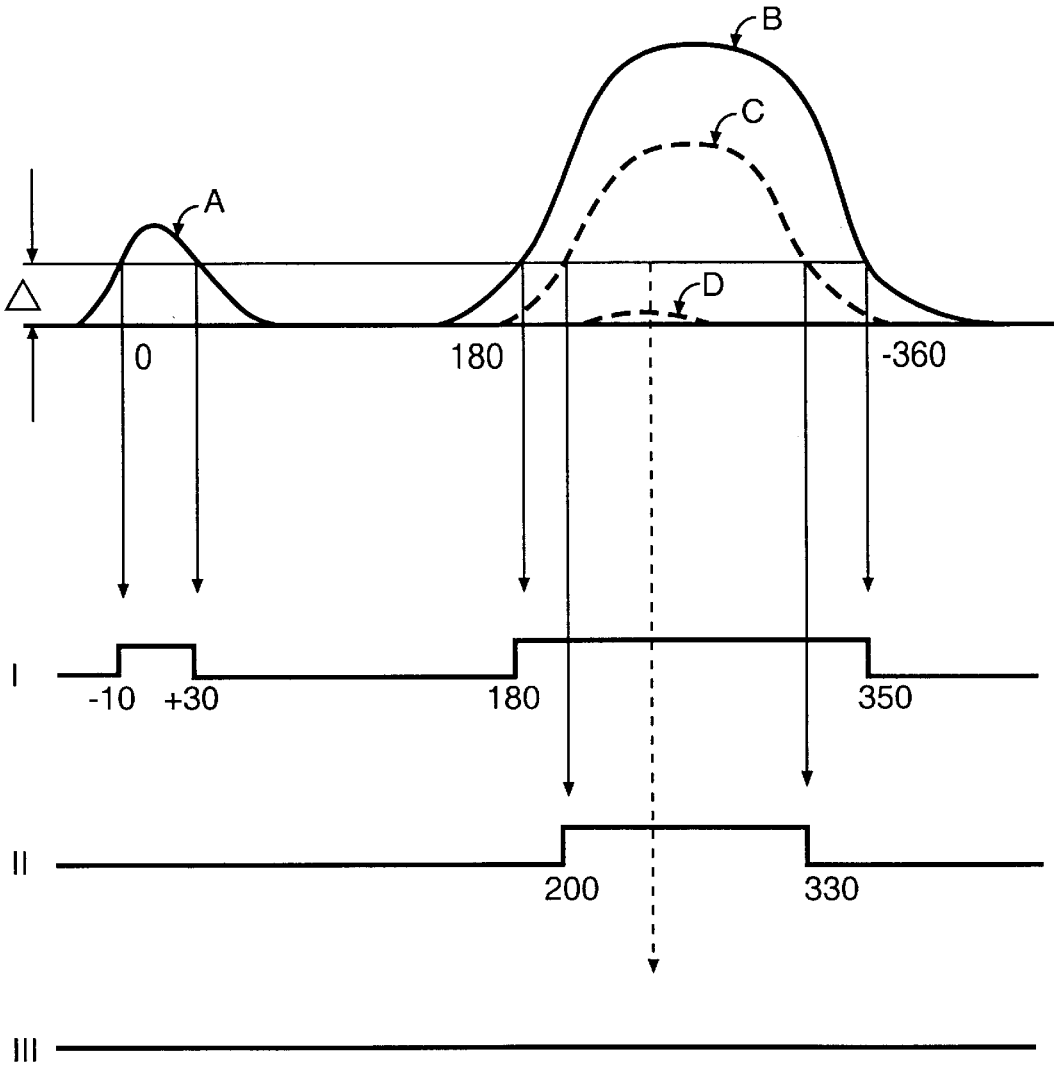
FIG. 2 is a graph depicting sensing signals in connection with valve actuation events.

Referring now to FIG. 2, a graph is shown depicting the sensing signals for several valve actuation events. As shown in FIG. 2, the valve motions are compared with several typical sensor outputs. Distance Δ represents the amount of motion of valve actuator 130 required to activate position sensor 610, causing position sensor 610 to change state from "off" to "on" or from "on" to "off." Three conditions are described. In condition I, position sensor 610 changes state during braking lift and return motion as illustrated by curve A, as well as during lift and return of the main exhaust event as illustrated by curve B. Control module 620 receives the output signal from the sensor 610 to determine whether or not valve actuation is operating properly. Condition I illustrates normal valve operation. For condition I, the crank angle degree is shown where position sensor 610 changes state: at braking lift (−10°) and return (+30°) along curve A, and at exhaust lift (180°) and return (−360) along curve B.

In condition II, the sensor 610 detects "late" valve opening exhaust event as illustrated by Curve C, relative to the normal opening illustrated by curve B, as well as the relatively "early" closing also illustrated by Curve C. For condition II, the crank angle degree is shown where position sensor 610 changes state: at exhaust lift (200°) and return (−330°) along curve B. In response to condition II, control module 620 may generate the necessary signals to operate control valve 200 of valve actuation system 10. Adjustments to the system can be made to produce valve opening for a normal exhaust event as shown in condition I.

In condition III, no valve motion occurs and sensor 610 does not change state, as illustrated by curve D. If valve motion were expected, an error condition is generated by control module 620. In response, control module 620 may shut off fuel injection or other valve motions for an affected cylinder in order to prevent engine damage.

It will be apparent to those skilled in the art that various modifications and variations can be made in the construction and configuration of the present invention without departing from the scope or spirit of the invention. For example, it is contemplated that the control module 620 can "poll" the input from the sensor 610 as needed to verify a condition, or "wait" for a change in state to determine an actual switching time. Furthermore, it is contemplated that multiple sensors can be used from different sources of motion on one controller input for a "superimposed" signal. Multiple sensors can be used on the same actuator for redundancy or varying levels of detection. The system can be used to detect the presence or absence of an event, the timing of the event, or any combination thereof. Furthermore, it is contemplated that the motion feedback system may be located within the manifold for the valve actuation system 10, as shown in FIG. 1. Similarly, the motion feedback system may be exteriorly attached to the manifold. Accordingly, it is possible to retrofit existing valve actuation systems. Thus, it is intended that the present invention cover the modifications and variations of the invention.

Figure 3:
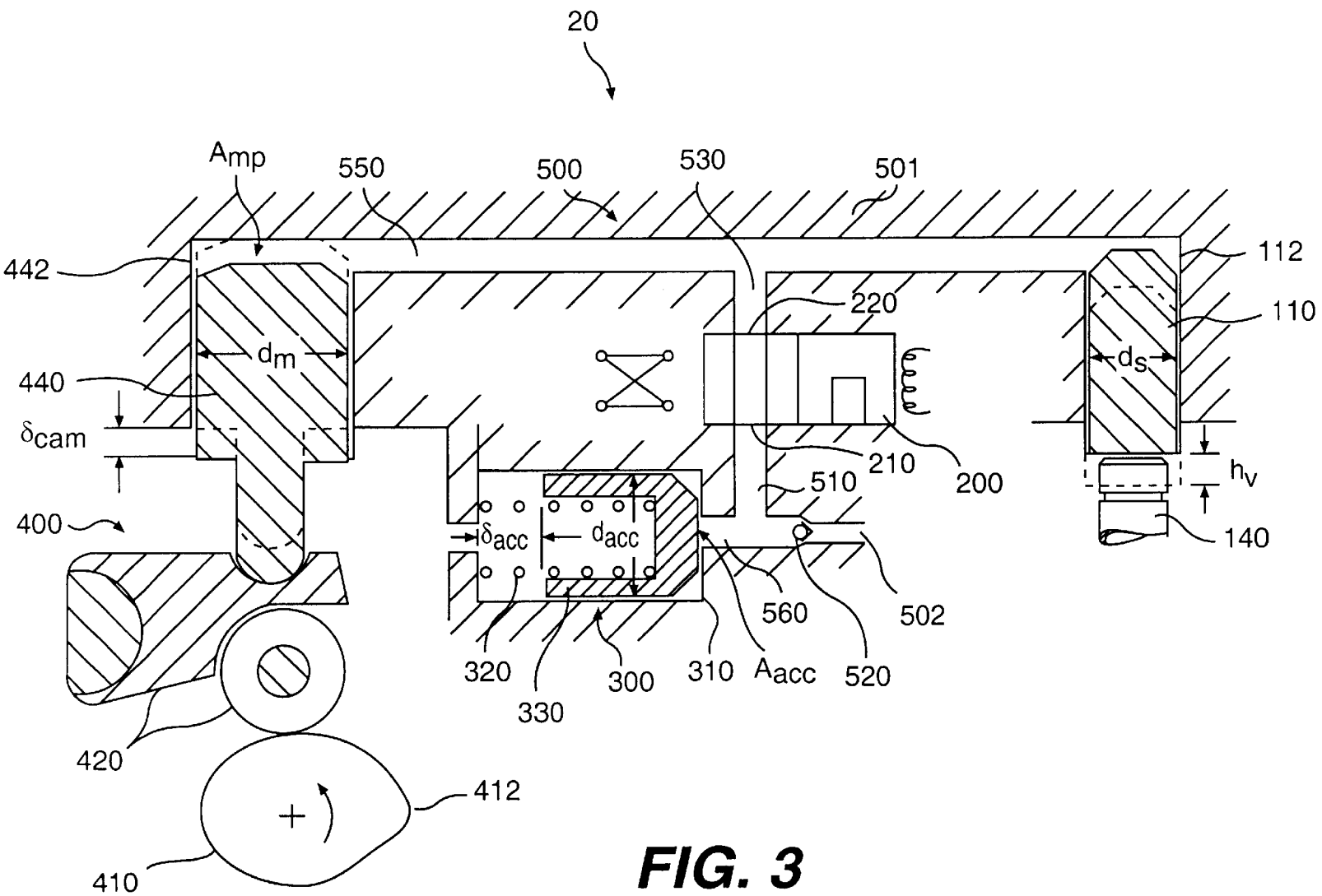
FIG. 3 is a cross-sectional schematic diagram of a valve actuation system according to an alternate embodiment of the present invention.

Referring now to FIG. 3, another embodiment is shown as 20. In this embodiment, master piston 440, located axially within brake housing 501, is connected to one or more slave pistons 110 via fluid system 500. Control valve 200 allows isolation from or connection to accumulator 300. Control valve 200 is provided with first port 210 for fluid intake from fluid system 500 and second port 220 for fluid outflow back to fluid system 500. Control valve 200 is preferably a high-speed, normally open, solenoid valve.

Accumulator 300 is provided with accumulator piston 310 and accumulator spring 320. Accumulator piston 310 is slidably disposed in accumulator 300, and is urged toward fluid source end of accumulator 300 by accumulator spring 320. Accumulator piston 310 is provided with accumulator stop 330, which limits motion of accumulator piston 310 in accumulator 300.

Fluid system 500 includes fluid intake port 502 for inflow of fluid from a fluid source (not shown), first fluid passage 510 connecting fluid intake port 502 to first port 210 of control valve 200, second fluid passage 530 for outflow of fluid from second port 220 of control valve 200, third fluid passage 550 connecting master piston 440 to slave piston 110, fourth fluid passage 560 connecting accumulator 300 to fluid system 500 and check valve 520 for restricting the flow of fluid back to the fluid source.

Alternate embodiment 20, as shown in FIG. 3, operates as follows: cam 410 motion is transferred to engine valve 140 by means of fluid system 500. When control valve 200 is open, working fluid is taken into accumulator 300 until accumulator piston 310 is driven against some limit, shown in this embodiment as solid stop 330. After accumulator piston 310 is driven against stop 330, additional motion of master piston 440 will result in slave piston 110 displacement regardless of the condition of control valve 200. This will occur as long as:

$$\delta_{acc}<(\delta_{cam}*A_{mp})/A_{acc}.$$

Where:

$\delta_{acc}$=the maximum stroke of accumulator 300;

$\delta_{cam}$=the maximum master piston lift due to cam 410;

$A_{mp}$=the cross-sectional area of master piston 440; and $A_{acc}$=the cross-sectional area of accumulator 300.

Figure 4:
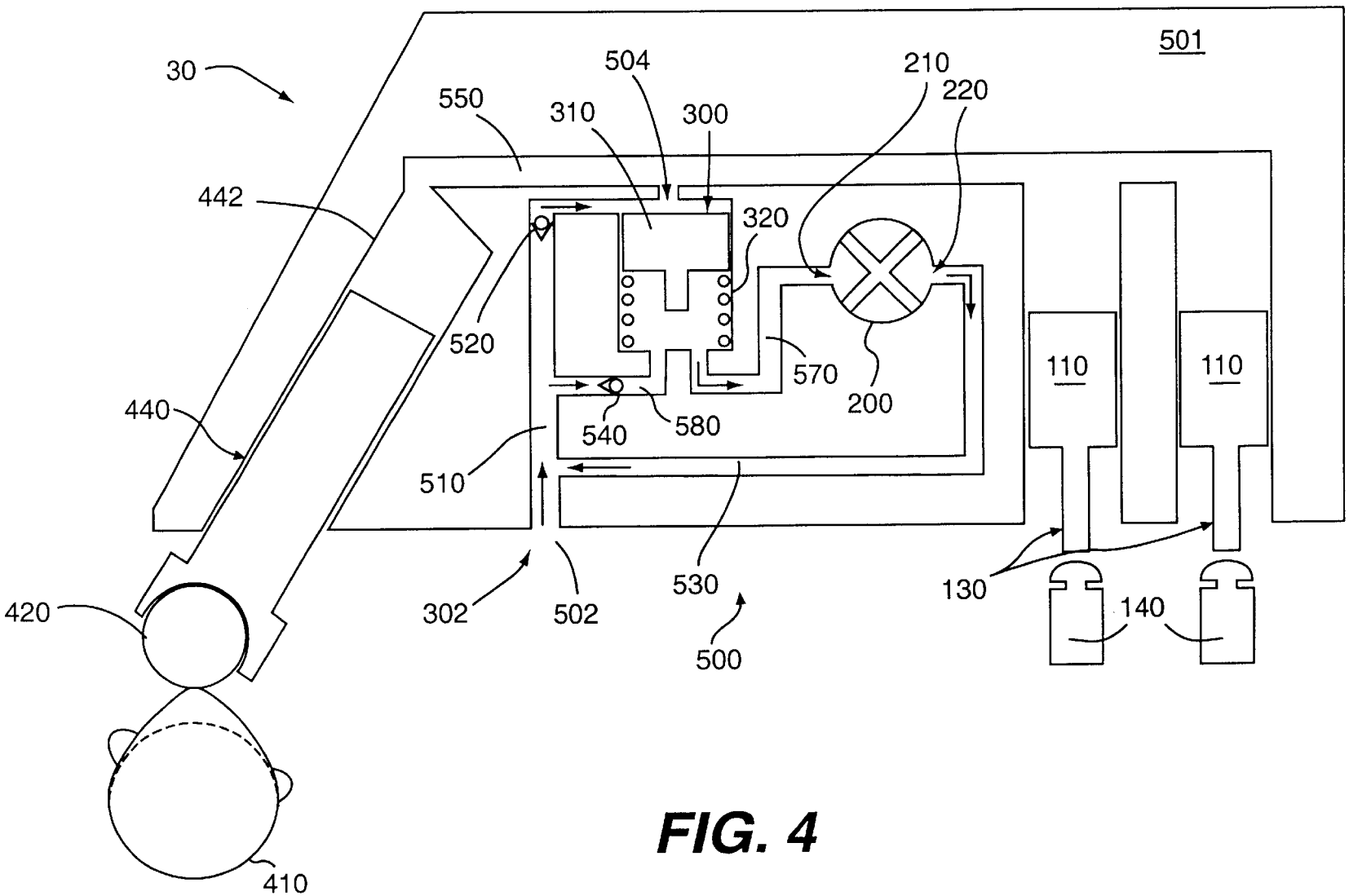
FIG. 4 is a cross-sectional schematic diagram of a valve actuation system according to a second alternate embodiment of the present invention.

Referring now to FIG. 4, another embodiment of the present invention is shown as valve actuation system 30. For simplicity, valve actuation system 30 is shown in connection with a single engine cylinder (not shown). In practice the invention could be applied to all engine cylinders. FIG. 4 depicts a multi-valve cylinder which includes two exhaust valves per cylinder. Multi-valve cylinders are common in contemporary internal combustion engines.

As embodied herein, valve actuation system 30 replaces an engine's mechanical exhaust valve opening system (normally consisting of combinations of camshafts, push-rods or push-tubes, rocker arms, and valve lifters) with an electrically controlled, hydromechanical system. Valve actuation system 30 comprises replacement cam 410 connected to master piston 440, slave pistons 110 connected to master piston 440 by means of fluid system 500, and accumulator 300 and control valve 200 connected to fluid system 500.

Accumulator 300 is preferably a limited accumulator. Lost motion valve actuation systems of the known art typically have control valves located on the main fluid passage connecting the master piston and the slave piston. In contrast, embodiment 30 of the present invention has control valve 200 connected to fluid system 500 downstream from accumulator 300. Intake of fluid into control valve 200 through first port 210 and fifth fluid passage 570 occurs when fluid flows out from accumulator 300. Control valve 200 may be a low-speed trigger valve. Hydraulic or other fluid may enter fluid system 500 through fluid intake port 502 and first fluid passage 510. First check valve 520 is located in first fluid passage 510. Accumulator 300 comprises accumulator piston 310 and accumulator spring 320. First fluid passage 510 is connected to accumulator 300 which may accept inflow of fluid from first fluid passage 510. Continued inflow of fluid from first fluid passage 510 displaces accumulator piston 310 until it reaches the end of accumulator 300. Fluid system 500 further comprises second fluid passage 530 for fluid outflow from control valve 200, third fluid passage 550 connecting master piston 440 with slave pistons 110, fifth fluid passage 570 for fluid outflow from accumulator 300 into control valve 200, and sixth fluid passage 580 for fluid inflow into accumulator 300. The present invention may supplement an otherwise conventional internal combustion engine with driver-initiated engine braking and EGR operating modes.

Replacement cam 410 includes exhaust valve cam lobes 412 (one per cylinder) that are machined to correspond with exhaust valve opening profiles optimized for positive power operation, engine braking, and EGR. Certain operating modes of the system, described below, permit exhaust valves 140 to replicate entirely the motions induced by the profile of cam 410.

As embodied herein, valve actuation system 30 as shown in FIG. 4 operates as follows: fluid system 500 is initially filled with fluid. Such fluid may be low-pressure (nominally 30–60 psi) engine lubricating oil from the engine crankcase (not shown) but other types of fluid are within the scope of and contemplated by the present invention. The initial filling and supply for maintaining low-pressure oil in fluid system 500 may be augmented by an additional low-pressure accumulator 302, located upstream from fluid intake port 502 in engine supply oil passage (not shown). Control valve 200 is normally open (de-energized). When the control valve 200 is open, low pressure oil moves freely to and from the chamber of accumulator 300. As cam 410 rotates, master piston 440 moves, displacing a volume of oil. The oil volume displaced by master piston 440 varies according to the profile of cam 410. The chamber of accumulator 300 is designed to absorb all of the oil displaced by master piston 440 in response to an engine braking or EGR lobe. Consequently, when control valve 200 is open or de-energized, slave pistons 110 do not move and exhaust valves 140 do not open in response to master piston motion generated by either an engine braking lobe or an EGR lobe. However, during positive power operation the oil volume displaced by master piston 440 is greater than the oil volume displaced during engine braking or EGR operation. Limited accumulator 300 cannot absorb all of the oil displaced when master piston 440 moves in response to a positive power cam lobe 412. During positive power operations with control valve 200 open, once accumulator 300 is full, master piston 440 and slave pistons 110 become hydraulically linked allowing slave pistons 110 to replicate the balance of cam lobe 412 displacement. Operation of valve actuation system 30 with control valve 200 open results in "lost motion," since all of master piston 440 motion is not transferred to slave piston 110. During positive power operation exhaust valves 140 will open some amount, regardless of the position of control valve 200. Since positive power operation may be maintained without electrical power, valve actuation system 30 includes a fail-safe operating mode.

As embodied herein, valve actuation system 30 is activated by closing control valve 200. Control valve 200 is closed upon receipt of a signal from the engine's electrical control system (not shown). With control valve 200 closed, oil cannot move into or out of accumulator 300. A full hydraulic link is established between slave pistons 110 and master piston 440. "Lost motion" is eliminated, and slave pistons 110 replicate master piston 440 motion, causing exhaust valves 140 to open for engine braking, EGR, and positive power operation.

Another embodiment of the present invention is a partial authority system. Valve actuation system 30 of the present invention, shown in FIG. 4, may be converted into a partial authority system by the following: (1) replacing limited accumulator 300 with an unlimited accumulator; and (2) replacing control valve 200 with a high-speed (nominally, a 2 millisecond response latency) trigger valve. The unlimited accumulator has sufficient capacity to absorb all of the oil displaced by master piston 440 when high-speed valve is open. In this embodiment, exhaust valve opening is controlled electronically for all modes of operation (positive power, engine braking, and EGR). The ability to electronically control the exhaust valve opening provides the operator with fine control of the system, since cycling the high speed trigger valve will result in exhaust valve opening. This embodiment allows dynamic optimization over the operating range (RPM) of the engine. The partial authority system does not provide a fail-safe mode, however, since an electrical signal must shut the high-speed trigger valve in order for the engine valves to operate.

Another embodiment of the valve actuation system 30 present invention includes a high-speed trigger valve and electronic timing control. This embodiment includes the elements shown in FIG. 4, with the exception of control valve 200 which is replaced by a high-speed trigger valve. Limited accumulator 300 remains part of the system. This embodiment provides dynamic optimization for the engine braking and EGR while retaining normal positive power operation and providing a fail-safe mode.

It will be apparent to those skilled in the art that various modifications and variations can be made in the construction and configuration of the present invention without departing from the scope or spirit of the invention. For example, with reference to valve actuation system 20, any means may be used to stop the accumulator after some displacement $\delta_{acc}$, including but not limited to a hydraulic cushion, mechanical stop, flow occluded by accumulator displacement, hydraulic lock, etc. Furthermore, it is contemplated that any additional system elements may be added without changing the scope of the invention, such as lash adjustment, valve seating, or other control devices. In addition, either a high or low speed solenoid may be used in alternate embodiment 20. Further, with reference to valve actuation systems 10, 20 and 30, it is contemplated that any suitable fluid may be used as the working fluid (including oil or fuel), and that valve actuation system systems 10, 20 and 30 may be used to control any type of engine valve (exhaust or intake) or injector. Thus, it is intended that the present invention cover the modifications and variations of the invention.

What is claimed is:

1. A valve actuation system for an internal combustion engine, said engine having at least one engine cylinder valve which is selectively openable, wherein said valve actuation system comprises:

means for imparting force from a force source to selectively operate said at least one engine valve, wherein said force imparting means includes a master piston for delivering motion from a cam;

a fluid system connected to said force imparting means for transferring force to selectively operate and variably control the position of said at least one engine valve;

a control valve connected to said fluid system;

an accumulator connected to said fluid system for selectively absorbing fluid within said fluid system to vary the operation of said at least one valve, said accumulator having means for limiting the amount of said fluid within said accumulator, such that when said accumulator reaches its maximum fluid limit, said fluid is retained within said fluid system to maintain positive power operation of said engine in the event of failure of said control valve;

means for actuating said at least one engine valve, in response to force imparted by said force imparting means through said fluid system, wherein said fluid system provides hydraulic control of lost motion between said at least one engine cylinder valve and said valve actuating means; and a motion feedback system for detecting braking and exhaust motion of said at least one engine valve in response to actuation of said at least one engine valve by said actuating means.

2. The valve actuation system of claim 1, wherein said actuating means comprises:

a slave piston slidably disposed within a slave piston bore in a brake housing, wherein said slave piston is connected to said fluid system; and a valve actuator connected to said slave piston, wherein said valve actuator is in communication with said at least one engine valve upon displacement of said slave piston.

3. The valve actuation system of claim 1, wherein said motion feedback system comprises:

at least one position sensor capable of detecting motion of said valve actuator; and a control module electrically connected to said at least one position sensor.

4. The valve actuation system of claim 3, wherein said control module is electrically connected to said control valve to control the operation of said control valve in response to motion detected by said at least one position sensor.

5. The valve actuation system of claim 4, wherein said at least one position sensor produces a position output signal in response to detecting motion of said valve actuator past a switching point.

6. The valve actuation system of claim 5, wherein said switching point is adjustable.

7. The valve actuation system of claim 1, wherein said accumulator includes an accumulator piston.

8. The valve actuation system of claim 7, wherein said limiting means of said accumulator limits the maximum stroke of said accumulator piston.

9. The valve actuation system of claim 8, wherein said limiting means of said accumulator limits the maximum stroke of said accumulator piston to a distance less than the maximum master piston lift.

10. The valve actuation system of claim 9, wherein said limiting means of said accumulator prevents said accumulator from absorbing the full volume of fluid displaced by said force imparting means during positive power operation of said engine.

11. The valve actuation system of claim 10, wherein said limiting means of said accumulator includes a control valve connected by said fluid system to said accumulator.

12. The valve actuation system of claim 11, wherein said control valve limits displacement of said accumulator piston in said accumulator when said control valve is closed.

13. The valve actuation system of claim 12, wherein said accumulator is capable of absorbing the full volume of fluid displaced by said master piston during predetermined operating conditions.

* * * * *